United States Patent [19]

Jensen

[11] 4,231,448

[45] Nov. 4, 1980

[54] DEMOUNTABLE BOAT LADDER

[76] Inventor: Svend O. Jensen, 1554 Farrell Crescent, Delta, British Columbia, Canada, V4L 1T8

[21] Appl. No.: 64,302

[22] Filed: Aug. 6, 1979

[51] Int. Cl.[3] ..... E06C 1/36; E06C 1/38; E06C 7/50

[52] U.S. Cl. ..... 182/93; 182/151; 182/194; 182/206

[58] Field of Search ..... 182/151, 206, 178, 93, 182/228

[56] References Cited

U.S. PATENT DOCUMENTS

| | | | |
|---|---|---|---|
| 918,039 | 4/1909 | Grundmann | 182/178 |
| 1,473,228 | 11/1923 | Grundel | 182/178 |
| 1,520,414 | 12/1924 | Hamilton | 182/178 |
| 2,364,521 | 12/1944 | Fairfax | 182/206 |
| 3,498,410 | 3/1970 | Storch | 182/206 |
| 3,512,608 | 5/1970 | Huntley | 182/93 |
| 3,647,023 | 3/1972 | Bedford | 182/93 |
| 3,757,896 | 9/1973 | Lee | 182/228 |
| 3,858,905 | 1/1975 | Peeble | 182/93 |
| 4,024,929 | 5/1977 | Mintz | 182/151 |

*Primary Examiner*—Reinaldo P. Machado
*Attorney, Agent, or Firm*—Townsend and Townsend

[57] ABSTRACT

A ladder intended for use in boarding small boats has side rails and treads interconnected by integral and precut joint elements designed for ready connection and disconnection. The connected treads and rails are suspended from the deck or side of a boat by crank-like hangers pivotally and releasably secured to the side rails and having grooves enterable by one of the treads. Anchoring members on the hangers engage corresponding fittings permanently secured to the boat to suspend the ladder over the side of the vessel. One of the treads has braces which engage the sloping side of the boat to keep the ladder rails generally vertical.

8 Claims, 9 Drawing Figures

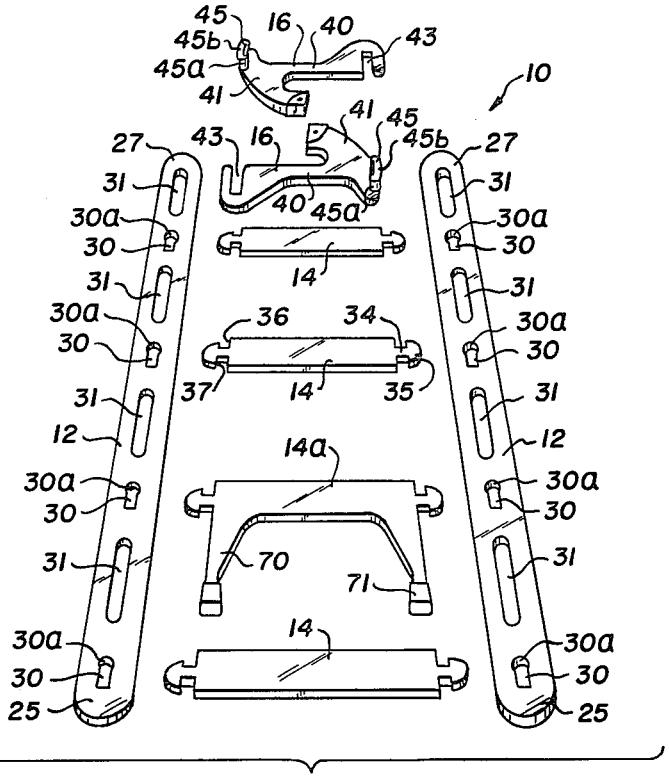
Fig. 1.
Fig. 2.
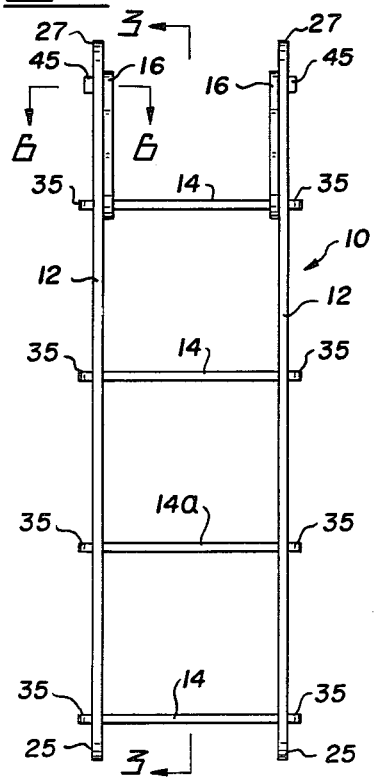
Fig. 3.
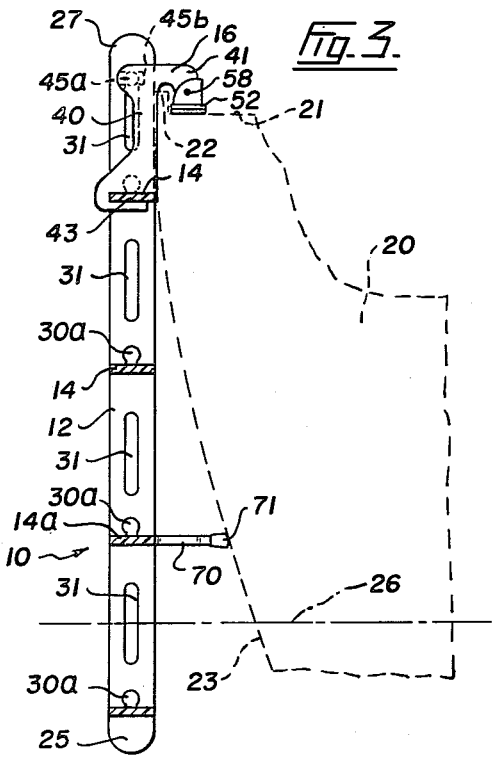

DEMOUNTABLE BOAT LADDER

BACKGROUND OF THE INVENTION

This invention relates to ladders and more particularly to a boarding ladder for small boats and the like.

When a vessel such as a power or sailing yacht is equipped with a boarding ladder, it is considered essential that the ladder be constructed so that it can be removed from the side or stern of the boat for storage aboard the craft when underway. Storage space aboard most small boats usually is in short supply and many boarding ladders are made foldable or collapsible so that they can be compacted to fit into a locker or elsewhere. Other ladders have parts which are bolted or otherwise secured together to allow for disassembly but this arrangement is objected to by boat owners since it is a tedious and time-consuming task to prepare such a ladder for storage or to reassemble it for use.

SUMMARY OF THE INVENTION

The present ladder provides an affective solution to the problem of dismantling a ladder for storage and reerecting it for use. This is accomplished by providing a knock-down ladder having all major parts interconnected by preformed joints which do not require additional fasteners to lock the parts together nor special tools for putting together or taking apart those parts. More specifically, a structure according to the present invention may be defined as a demountable boat ladder which comprises a pair of parallel side rails, a plurality of treads extending between the side rails, connecting means securing opposite ends of the treads to the side rails for ready connection and disconnection, a pair of hangers each having a first portion adjacent one of the side rails and a second portion disposed substantially at right angles to said first portion to project rearwardly of the ladder, attachment means releasably securing the hangers to the side rails and one of the treads, and anchoring means detachably securing rear ends of the second portions to the boat whereby to suspend the ladder alongside the boat.

BRIEF DESCRIPTION OF THE DRAWINGS

FIG. 1 is a perspective of the present demountable boat ladder as it might be arranged prior to assembly, FIG. 2 is a front elevation of the assembled ladder, FIG. 3 is a vertical section taken on the line 3—3 of FIG. 2 a showing the ladder in position of use.

DESCRIPTION OF THE PREFERRED EMBODIMENT

Figure 4:
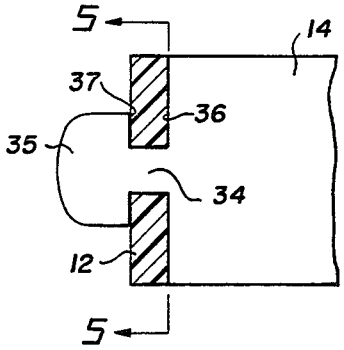
FIG. 4 is a plan view, part in section, showing connecting means for interconnecting treads and rails of the ladder.

Referring to the drawings, the numeral 10 indicates generally a demountable boat ladder constructed in accordance with the present invention. The ladder is shown in FIG. 1 dismantled and laid out as might be done for inspection shortly after removal from storage and immediately prior to being assembled and mounted on the side of a boat. The present ladder will be seen to comprise a pair of side rails 12, a plurality of treads 14, and a pair of hangers 16. All the ladder parts so far mentioned preferably are made of a suitable hard wearing plastic material such as polypropylene although wood or some other buoyant material can be used.

The ladder 10 is shown in FIGS. 2 and 3 as it would appear in assembled condition with FIG. 3 showing the structure suspended over the side of a boat 20. This vessel may be a small pleasure craft having a deck 21 and a gunwale 22 located above an inwardly-curving side 23 of the hull. Normally the lower ends 25 of the rails and the lowermost tread are immersed in the water which is represented by the chain dotted line 26 appearing in FIG. 3 while the upper ends 27 of the rails project a short distance above the deck 21.

Figure 5:
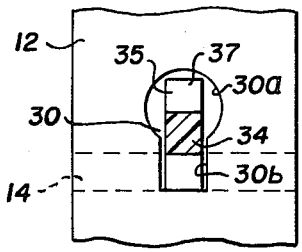
FIG. 5 is a transverse section taken on the line 5—5 of FIG. 4 but showing a tread turned on edge to allow joining to a side rail.

In order to facilitate assembly and disassembly of the vertical and horizontal members which make up the ladder 10, the identical rails 12 are provided with a number of openings 30 and slots 31. There is one opening 30 near the lower end 25 of each rail and a slot near the upper end 27 thereof. Other such openings and slots are longitudinally spaced apart on the rails so as to alternate, that is, there is one opening equidistantly spaced between the ends of adjacent slots. As best seen in FIG. 5, each opening 30 is provided with an upper enlargement **30*a* which is substantially semi-circular and a lower seat 30*b*** which is rectangular.

The treads 14 preferably are the same width and thickness as the rails. The opposite ends of the treads are each shaped to provide a neck 34 which is square in cross section and a head 35 which has the same thickness as the tread. The heads and adjacent ends of the treads have opposing edges 36 and 37 which are parallel and spaced apart a distance only slightly greater than the thickness of the rails.

The foregoing arrangement provides the ladder 10 with connecting means which allows the rails and treads to be quickly and easily assembled as well as taken apart. Assembly is done with the rails 12 parallel and with their inner faces spaced apart a distance greater than the overall length of the treads. The treads 14 are then placed between the rails to align approximately with the openings 30. One by one the treads are turned on edge so that the heads 35 and necks 34 can be threaded through the openings. As will be appreciated by the showing in FIG. 5, the length of the openings will accommodate the widths of the heads when the treads are placed on edge or at right angles to the position shown in FIG. 4 for example. All the treads must be joined to the rails in this manner before the treads are rotated 90° and this rotation can only be done when the square necks 34 are within the enlargements **30*a*. The necks are slightly oversize with respect to the seats 30*b* and, once the treads are rotated as described, a reasonable amount of pressure must be exerted to force the necks into the narrow lower seats forming part of the openings. Thus, the necks 34 are wedged in the seats and the opposing edges 36 and 37** engage the opposite faces of the rails so that the treads are firmly held in position and there is no free play between these major parts of the present ladder.

Figure 6:
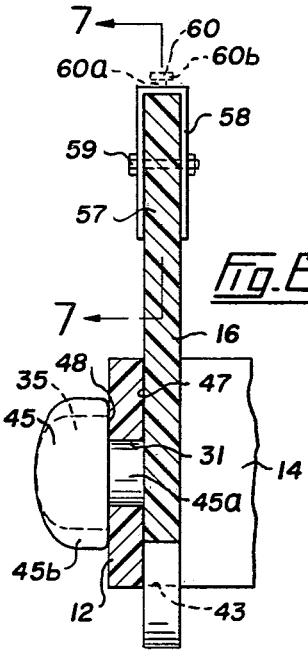
FIG. 6 is a detail section taken on the line 6—6 of FIG. 2.

The pair of hangers 16 are of a substantially T-shaped configuration which provides a tread-engaging portion 40 and a rearwardly-projecting portion 41. In FIG. 3, the portion 40 will be seen to have a rectangular groove 43 which is shaped to closely fit any one of the treads 14. The opposite end of the leg 40 is fitted with a substantially T-shaped connector 45 having a stem 45*a* and a cross bar 45*b*. As shown best in FIG. 6, the stem is cylindrical in cross section to conform to the rounded ends of the slots 31. The bar 45*b* is of a thickness which will allow it to pass through the slots 31 but the length or major dimension of the bar is greater than the width of the slots and the axis on which that major dimension lies is parallel to the longitudinal axis of the adjacent groove 43. FIG. 3 also shows that the hanger and the cross bar have opposing edges 47 and 48 which are parallel and spaced apart a distance only slightly greater than the width of the rails.

The connector 45 and the tread-engaging grooves 43 provide means for attaching the pair of hangers to the remainder of the ladder and this is done in a prescribed manner. Assuming the uppermost slots 31 and the uppermost tread are selected to support the hangers, each hanger in turn is positioned beside the inner face of the rail and is then rotated about a transverse axis so that the connector 45 can be threaded through the selected slot. When the stem 45*a* is within the slot and the cross bar 45*b* is alongside the outer face of the rail, the hanger is rotated about the axis of the stem so as to swing the leg 40 downwardly and rearwardly whereby to lodge the uppermost tread in the rectangular slot 43 as shown in FIG. 3. The hangers are then secured to both the rails and one of the treads so that disengagement cannot take place particularly when the ladder is carrying a load.

Figure 9:
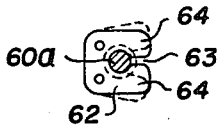
FIG. 9 is a section similar to FIG. 8 but taken on the line 9—9 of FIG. 7.

The demountable boat ladder 10, when assembled in this matter, is secured to the boat by anchoring means generally indicated at 50. As shown best in FIGS. 7, 8 and 9, the means 50 for each attaching each hanger to the boat comprises an anchor plate 52 which is secured, for example, to the deck 21 near the gunwale 22 (FIG. 3). The two spaced-apart anchor plates are each secured to the deck by screws 54 and the raised portion of the inverted U-shaped plate is provided with a keyhole slot 55.

Figure 7:
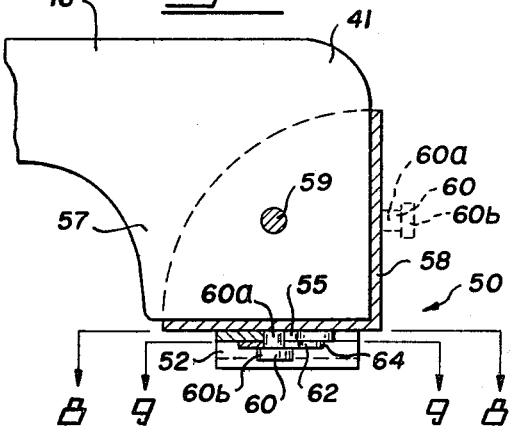
FIG. 7 is a transverse section taken on the line 7—7 of FIG. 6 and showing anchoring means used to secure the ladder to a boat.
Figure 8:
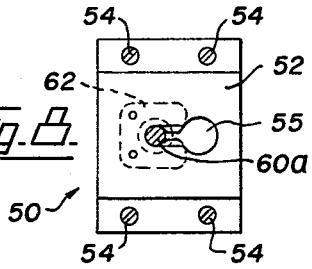
FIG. 8 is a horizontal section, part in elevation, and taken on the line 8—8 of FIG. 7.

Referring now particularly to FIG. 7, the rearwardly-projecting portion 41 of each hanger will be seen to have a rear end 57 which is partly enclosed by a metal fitting 58. A bolt and nut 59 are used to fasten the socket-like fitting 58 to the end 57 of the hanger. This fitting carries a stud 60 having a cylindrical shank 60*a* and an enlarged head 60*b*.

When the anchor plates 52 are secured to a substantially horizontal surface such as the deck of a boat, the fittings 58 are positioned so that the studs project vertically downwards as shown in FIG. 7. The studs 60 are then entered into the wide portions of the keyhole slots 55 whereupon the ladder is pulled outwardly to lodge the shanks 60*a* in the narrow portion of the keyhole slots. On the underside of each anchor plate 52 there is secured a locking device 62 which is shown best in FIG. 9. The substantially U-shaped device 62 is formed of spring material which is shaped to provide a gap 63 defined between opposing lobes 64, the gap being narrower than the diameter of the shanks 60*a*. The lobes 64 must be forced apart by the shanks in order for those shanks to traverse the narrow portion of the keyhole slots. When the lobes spring back to their normal positions, they provide stops which prevent accidental disengagement of the anchoring means.

Referring to FIGS. 1 and 3, one of the treads designated as 14*a* will be seen to be provided with a pair of bracing legs 70. These legs are integrally formed with the tread and are located one at each end of the tread so as to project rearwardly of the ladder when properly assembled. The free ends of the legs 70 are fitted with rubber caps 71.

The tread 14*a* is shown in FIG. 3 located above the lowermost tread 14 so as to bear against a convenient part of the inwardly-curving side 23 of the boat. This arrangement keeps the rails 12 of the ladder vertical as is desirable and with only the lowermost tread immersed in the water. It will be appreciated that the several treads are interchangeable and that the tread 14*a* can be fitted to the rails either above or below the location shown in FIG. 3 as determined by the curvature of the boat side. Also the lower end of the ladder can be immersed to a greater or lesser depth depending on the amount of freeboard and other factors.

When a boat is tied up alongside a dock, it may be convenient to provide a few steps up onto the deck and the present ladder can be used for this purpose as well. The lower end 25 of the rails 12 are positioned a suitable height above the level of the dock at which time the pair of hangers 16 are secured to the rails usually in a location lower than the one shown in FIG. 3. This arrangement normally places the upper ends 27 of the rails well above the deck level so that they can be used as handholds when climbing aboard.

If the side 23 of the boat curves sharply in a horizontal plane as is often the case, one of the bracing legs 70 can be shortened accordingly whereby to compensate for that curvature. The ladder is useable on either side of the boat when a leg 70 is shortened since it is a simple matter to invert the tread 14*a* so that both pads 71 are in proper contact with the hull.

From the foregoing it will be apparent the present demountable boarding ladder has parts which can be dismantled and then be stacked in any convenient manner for storage aboard a small boat where space is at a premium. The task of reassembling the ladder and mounting it in a position of use is an extremely simple one. All the parts are wedged together, so that separation will not take place, for example, by wave action, and the weight of a person using the ladder tends to increase the wedging or holding action of the several joints interlocking the major parts of the ladder so that there is no likelihood of accidental collapse when in use.

I claim:

1. A boarding ladder for a boat comprising:

a pair of parallel side rails, a plurality of treads extending between the side rails, connecting means securing opposite ends of the treads to the side rails for ready connection and disconnection, a pair of hangers each having a first portion adjacent one of the side rails and a second portion disposed substantially at right angles to said first position to project rearwardly of the ladder, attachment means releasably securing the hangers to the side rails and one of the treads, and anchoring means detachably securing rear ends of the second portions to the boat whereby to suspend the ladder alongside the boat.

2. A boarding ladder as claimed in claim 1, in which a lower one of said treads is provided with bracing legs adapted to bear against a part of the boat near the waterline.

3. A boarding ladder as claimed in claim 1, in which said connecting means comprises a neck and a head formed on each opposite end of the treads, said side rails having longitudinally-spaced openings through which the heads can be threaded when the threads are placed on edge, said openings each including an upper enlargement and a lower seat, the construction and arrangement being such that the treads are rotatable about their longitudinal axes when the necks are located within the upper enlargements and the necks are wedged in the lower seats when the treads are moved to a normal position of use.

4. A boarding ladder as claimed in claim 1, in which each of said attachment means comprises a connector near the junction of the first and second portions, said side rails having a plurality of longitudinal-spaced slots, said connectors being threadable through selected slots in the side rails to pivotally secure the hangers to said rails, and said first portion having a lower end provided with a groove in which said one of the treads is lodged.

5. A boarding ladder as claimed in claim 1, in which each of said anchoring means comprises an anchor plate secured to the boat and having a keyhole slot, a fitting secured to the rear end of the second portion and having a projecting stud enterable into the keyhole slot, and a locking device on the anchor plate engaging the stud to prevent accidental withdrawal of said stud from the keyhole slot.

6. A boarding ladder as claimed in claim 5, in which said fitting is pivotally secured to the rear end of the second portion by a pivot bolt which allows the fitting to be positioned with the stud projecting downwardly or rearwardly.

7. A boarding ladder for a boat comprising a pair of side rails, a plurality of treads extending between the side rails, said treads each having a neck and a head formed at opposite ends thereof, said side rails having longitudinally-spaced openings through which the heads can be threaded only when the treads are placed on edge, said openings each including an upper enlargement and a lower seat, the construction and arrangement being such that the treads are rotatably about their longitudinal axes when the necks are located within the upper enlargements and the necks become wedged in the lower seats when the treads are moved to a normal position of use, a pair of hangers each having a first portion alongside one of the side rails and a second portion projecting rearwardly of the ladder, a connector at the junction of each of the first and second portions, said side rails having a plurality of longitudinally-spaced slots, said connectors being threadable through selected slots in the side rails to pivotally connect the hangers to said rails, and said first portions each having a lower end provided with a groove in which an adjacent tread is lodged, one of said treads being provided with bracing legs adapted to bear against a part of the boat, and anchoring means detachably securing rear ends of the second portions to the boat with the ladder suspended alongside the boat.

8. A boarding ladder as claimed in claim 7, in which each of said anchoring means comprises an anchor plate secured to the boat and having a keyhole slot, a fitting secured to the rear end of the second portion and having a projecting stud enterable into the keyhole slot, said fitting being secured to the rear end of the second portion by a bolt which allows the fitting to be positioned with the stud projecting downwardly or rearwardly, and a locking device on the anchor plate engaging the stud to prevent accidental withdrawal of said stud from the keyhole slot.

* * * * *